US009079741B2

(12) United States Patent
Lam

(10) Patent No.: US 9,079,741 B2
(45) Date of Patent: Jul. 14, 2015

(54) TAPE APPLICATOR TO APPLY TAPE TO A VERTICAL SIDE OF A CASE

(71) Applicant: LAMUS ENTERPRISES INC., Vancouver (CA)

(72) Inventor: Joe Augustine Lam, Vancouver (CA)

(73) Assignee: LAMUS ENTERPRISES INC., Vancouver, BC (CA)

( * ) Notice: Subject to any disclaimer, the term of this patent is extended or adjusted under 35 U.S.C. 154(b) by 38 days.

(21) Appl. No.: 13/959,884

(22) Filed: Aug. 6, 2013

(65) Prior Publication Data

US 2015/0041063 A1 Feb. 12, 2015

(51) Int. Cl.
*B44C 7/00* (2006.01)
*B65H 35/00* (2006.01)

(52) U.S. Cl.
CPC ..... *B65H 35/0026* (2013.01); *B65H 35/0013* (2013.01); *B65H 35/0033* (2013.01); *B65H 2301/312* (2013.01); *B65H 2301/332* (2013.01); *B65H 2301/33222* (2013.01); *Y10T 156/12* (2015.01); *Y10T 156/17* (2015.01); *Y10T 156/1717* (2015.01); *Y10T 156/1734* (2015.01)

(58) Field of Classification Search
CPC ..... B65H 35/0013; B65H 35/0033; B65H 2301/312; B65H 2301/3121; B65H 2301/332; B65H 2301/33222; Y10T 156/17; Y10T 156/12; Y10T 156/1717; Y10T 156/1734
USPC ..... 156/522, 577; 53/136.1, 136.3, 136.4
See application file for complete search history.

(56) References Cited

U.S. PATENT DOCUMENTS

| | | | | |
|---|---|---|---|---|
| 2,147,738 | A | 2/1939 | Lipfert | |
| 3,136,462 | A * | 6/1964 | Knutson | 225/24 |
| 3,423,042 | A * | 1/1969 | Lipfert | 242/421.5 |
| 4,320,835 | A * | 3/1982 | Polhemus et al. | 206/411 |
| 4,401,503 | A | 8/1983 | Hertel | |
| 4,419,170 | A * | 12/1983 | Blad | 156/361 |
| 5,025,608 | A | 6/1991 | Marchetti | |
| 5,791,586 | A * | 8/1998 | Cayford et al. | 242/571.4 |
| 2004/0238109 | A1 * | 12/2004 | Gonzalez | 156/227 |

FOREIGN PATENT DOCUMENTS

CN 201210125353.5 8/2012

* cited by examiner

*Primary Examiner* — Alex Efta

(57) ABSTRACT

A tape applicator to apply tape onto a vertical face of a carton with the tape roll mounted for rotation on a horizontal axis and including a tape deforming device position on a tape path between the tape roll and the point of application of the tape to the carton. The tape deforming device twists the plane of the tape through 90° from horizontal when leaving the tape roll to vertical for application to the vertical face of the carton. The tape applicator can adjust the position of the tape at the point of application to the carton vertically.

1 Claim, 6 Drawing Sheets

TAPE APPLICATOR TO APPLY TAPE TO A VERTICAL SIDE OF A CASE

CROSS REFERENCE TO RELATED APPLICATIONS

Not applicable

STATEMENT REGARDING FEDERALLY SPONSORED RESEARCH OR DEVELOPMENT

Not Applicable

REFERENCE TO MICROFICHE APPENDIX

Not Applicable.

FIELD OF INVENTION

The present invention relates to an improved tape applicator for applying tape to a substantially vertical side of a case while minimizing the lateral space requirement for the machine, facilitating tape replenishment and preferably providing for tape alignment adjustment.

BACKGROUND OF THE PRESENT INVENTION

Tape applicators are being use to apply adhesive tape to seal a case or carton in a carton sealer machine using a conveyor to advance the carton through the machine for top and bottom tape application. The tape applicator is usually removable in and out of the machine to facilitate tape replenishing and servicing. A conventional tape applicator comprises of a main frame with tape application mechanism, tape cutting mechanism and a tape roll mounting arm with a retaining hub to secure the tape roll. The axis of rotation of the tape roll is parallel to that of the application roller which is also parallel to the surface of the carton to be taped.

The above mentioned in-line tape-roll tape applicator reduces any tape misalignment issues and provides even tension while dispensing the tape from the tape roll for normal tape application i.e.: top and bottom providing horizontal surfaces to be taped. The problem arises when taping a carton on vertical taping surfaces. The tape applicator has to be positioned horizontally to apply tape on the vertical surface.

A basic adhesive tape normally is comprised of plastic (Bi-oriented polypropylene (BOPP)) film, one side with release layer and the opposite side with adhesive layer, the adhesive is always maintain in a fluidic state which is not stable. The shape of the tape roll may change due to winding tension during manufacturing, storage and application temperature, etc., and most importantly the positioning of the tape roll during application. If the tape roll is mounted onto the tape applicator oriented horizontally i.e. with the axis of rotation of the tape roll vertical, a mild warm temperature will likely cause the tape roll to shack down-ward adjacent to its periphery and form a conical shape in a very short time. To stabilize the tape roll and avoid tape roll deformation, a round disk with the same diameter of the fresh tape roll has to be installed under the tape roll to provide support. However, since the disk has to turn with the tape roll, it increases the inertia for high speed application. It is not ideal to have the edge of the tape rubbing the surface of the disk during tape dispensing which may cause tape breakage if there is relative movement between the disk and tape which must occur if the disk is fixed and may occur even when the disk is free to rotate.

One other disadvantage of using the conventional in-line tape applicator for horizontal taping is space utilization. The average height of a tape applicator main body is 8 inches, but an additional 17 inches must be provided to accommodate the tape roll and its mounting. A loaded tape applicator can be over 2 feet tall and when turned on its side for tape application to a vertical surface requires an addition lateral space thereby increasing the machine space requirements. The additional lateral space creates a significant ergonomic disadvantage for the operator in threading the tape from the tape roll including the cutting off of the end of the tape at the application roller, since the operator has to reach in to perform these operations and/or perform any further adjustments often needed during the taping operation. See for example U.S. Pat. No. 5,025,608 issued Jun. 23, 1991 to Marchetti.

Chinese patent 201210125353.5 shows a very complicated system for applying tapes to vertical surfaces of cartons. In this system the tape is mounted for rotation on a horizontal axis positioned in a separate station spaced from the applicator and is turned 90° i.e. the plane of the tape is turned from horizontal to vertical for application to the carton. The invention incorporates a tape splicing system to facilitate tape replenishment in operation but it is clear that the space requirements are significant.

It has been known for a long time to turn the plane of the tape through 90° as it is dispensed from a tape roll and passes to the point of tape application, see for example U.S. Pat. No. 2,147,738 issued Feb. 21, 1939 or U.S. Pat. No. 3,423,042 issued Jan. 21 1968 to Lipfert or U.S. Pat. No. 4,401,503 issued Aug. 30, 1983 to Hertel. The use of an adjustable angle plate or long roller which has to be adjusted properly to orient the tape to align with the application roller has limited effectiveness. Intermittent tape movement and uneven tape tension may cause the tape to shift and/or lose alignment. Tracking rollers with side flanges used to guide both edges of the tape, but these tracking (side guide) rollers are only be effective with rigid thick tape and are not effective with normal thin gauge adhesive tapes.

The present invention provides an effective system for taping vertical faces of cases to render such application practical while reducing space requirements necessitated by earlier vertical face taper applicators. The invention provides for precise tape tracking adjustment.

BRIEF DESCRIPTION OF THE PRESENT INVENTION

It is the main object of the present invention to provide improved tape applicator for applying tape to a substantially vertical side of a case while minimizing the lateral space requirement for the machine and facilitating tape replenishment. The invention also may include tape alignment adjustment for more accurate tape tracking Broadly the present invention relates to a tape applicator to apply tape onto a vertical face of a case comprising a machine frame, a tape applicator removeably mounted on said machine frame, said tape applicator having a tape applicator roll for apply tape against a vertical face of case moved thereby and a tape roll mounting for mounting a tape roll on said tape applicator, said tape roll providing a source of tape to be applied, said tape roll mounting mounts said tape roll for rotation on a horizontal axis so that said tape leaves said tape roll with its plane a horizontal and a tape deforming device to turn said tape so that said plane of said tape is changed 90° from horizontal to vertical so that when leaving said deforming device said plane is parallel to said vertical face of said case and guides for directing said tape along a tape path to said tape deforming device and to said applicator roll.

Preferably said tape deforming device comprises a rectangular strip having a horizontal inlet end fixed to said applicator and a vertical outlet end spaced from said inlet end and fixed to said applicator said strip being bent to form a deforming edge between said inlet and outlet ends over which said tape travels to turn said plane of said tape through 90°.

Preferably, said tape applicator has substantially parallel top and bottom fame members, an arm mounted on one of said top and bottom frame members and extending perpendicular thereto and said mounting for mounting said tape roll includes a hub mounted on said arm for rotation on an axis substantially perpendicular to said arm.

Preferably, said tape applicator further comprises a releasable mounting releaseably mounting said applicator to a machine fame of a tape applying machine.

Preferably said tape roll mounting includes a hub on which said tape roll is mounted and wherein said hub is, axially adjustable relative to said guides.

BRIEF DESCRIPTION OF THE SEVERAL VIEWS OF THE DRAWINGS

Further features, objects and advantages will be evident from the following detailed description of the preferred embodiments of the present invention taken in conjunction with the accompanying drawings in which.

DETAILED DESCRIPTION OF THE INVENTION

Figure 1:
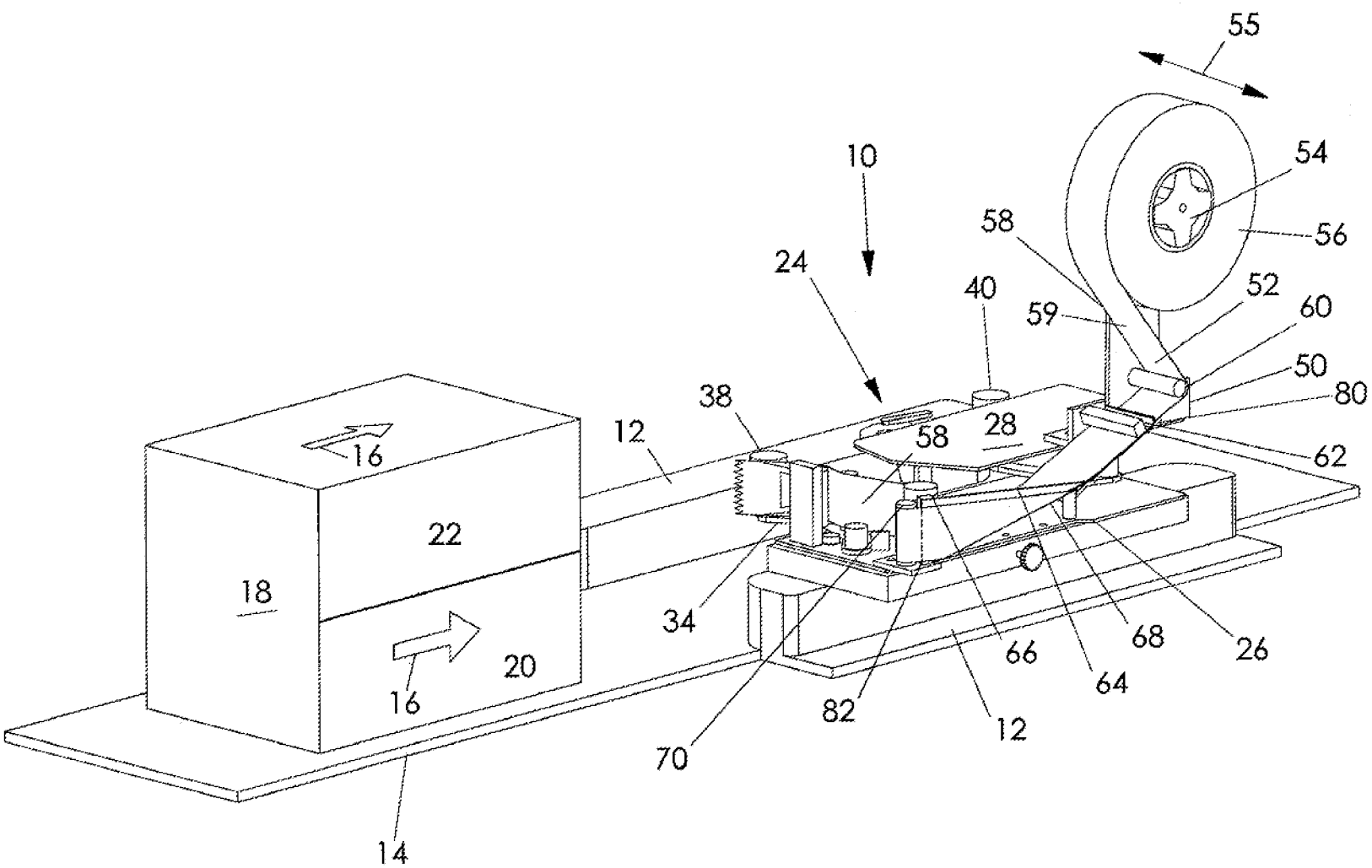
FIG. 1 is an isometric illustration of the present invention showing the tape applicator mounted to the taping machine frame and in position to apply a tape to a vertical side of a case or carton.

The tape applicator device or machine 10 shown in the Figures includes the tape applicator 24 of the present invention removeably mounted to the fame 12 of the taping machine that in conventional manner is provided with a conveyor 14 that moves in a direction as indicated by the arrows 16 a case or carton 18 having its closure flaps 20 and 22 positioned in and defining a substantially vertical plane so that the sealing tape being applied must be in a vertical plane to correspond with that of the closure flaps 20 and 22 that are to be sealed.

Figure 2:
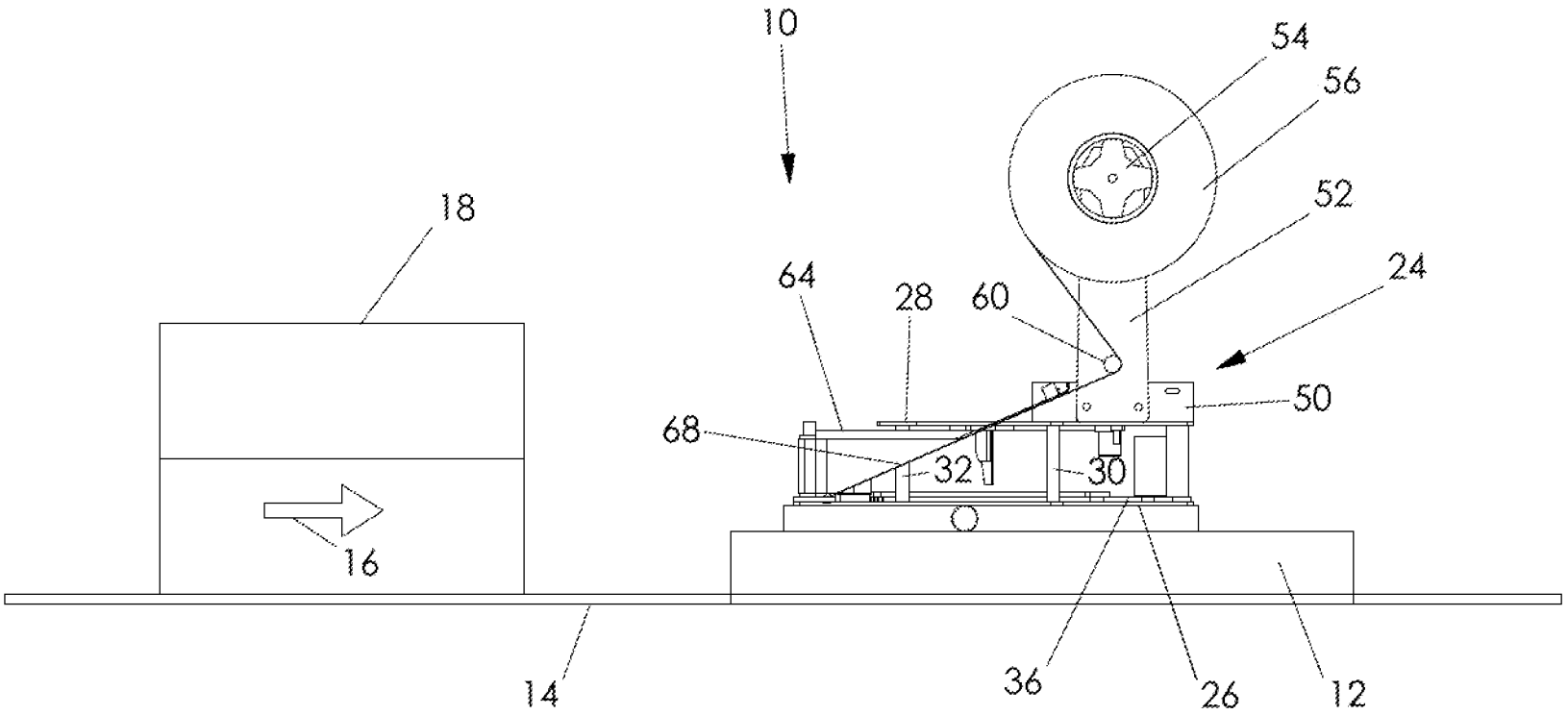
FIG. 2 is a side elevation view of the device of FIG. 1.
Figure 3:
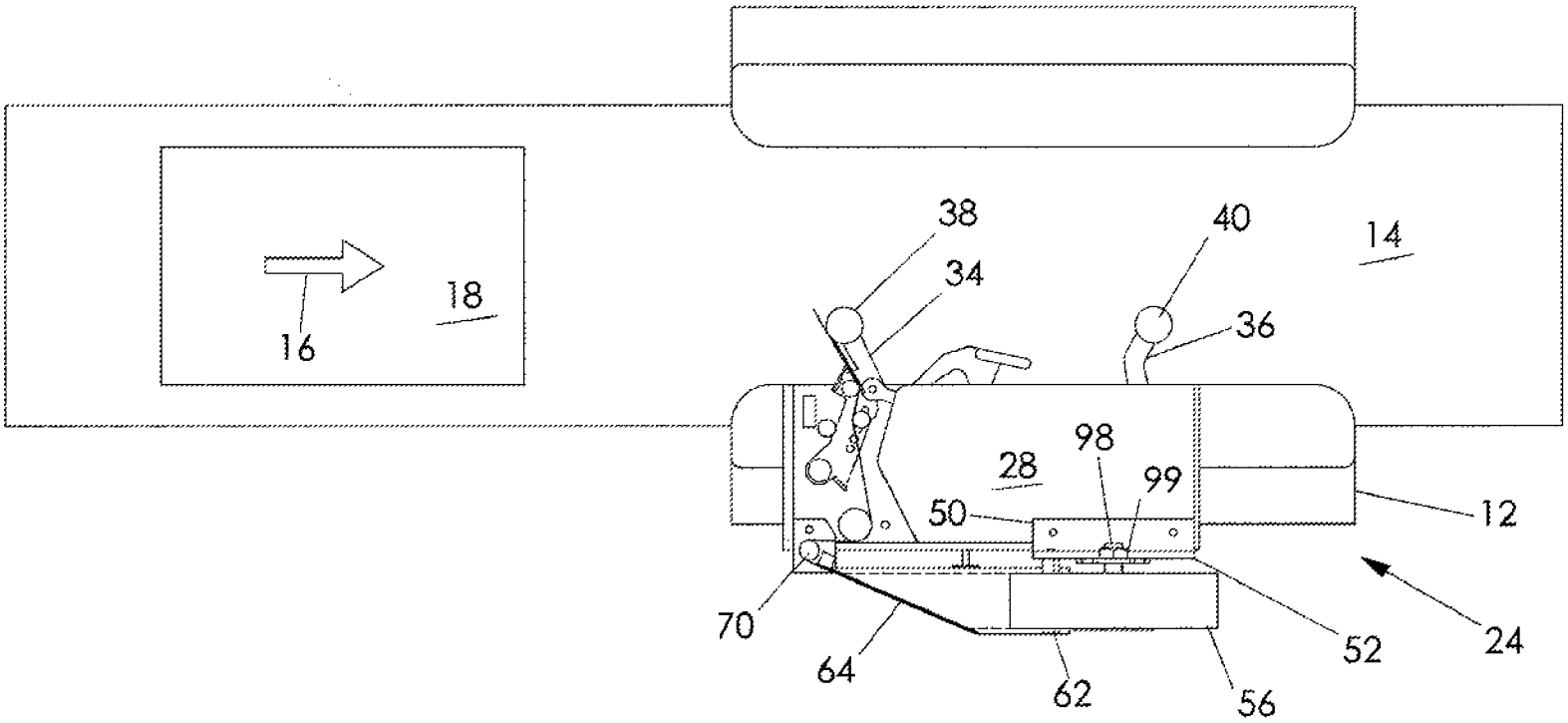
FIG. 3 is a plan view of the device of FIG. 1.

As shown the tape applicator 24 includes a conventional tape applicator positioned on its side and formed by a back or bottom frame 26 and a front or top frame 28 interconnected in spaced parallel relationship in the conventional manner by suitable spacers 30 and 32 (see FIG. 2). Mounted between the frames 26 and 28 are the conventional applicator arm 34 and wipe down arm 36 which in turn mount are the applicator roll 38 and the wipe down roll 40 respectively (see FIG. 3). The tape applicator 24 is removably mounted on the machine frame 12 (as will be described below with reference to FIG. 4) with the planes of the frames 26 and 28 substantially horizontal so that the axes of rotation of the applicator roll 38 and wipe down 40 are vertical i.e. parallel to the vertical plane defined by the flaps 20 and 22.

The term rolls when used to represent the applicator and wipe down is intended to be interpreted broadly and include fixed curved guide surfaces having their surfaces substantially vertical.

Mounted on the frame 28 is a right angled bracket 50 to which a substantially vertical post or arm 52 is attached that extends perpendicular to the planes of the top bottom frame members 28 and 26. Adjacent to the end of said arm 52 remote from the bracket 50 is a rotatable hub 54 that extends perpendicular to the post or arm 52 and on which a tape roll 56 from which the tape 58 is dispensed for application by the applicator 24 to seal the carton or case 18. It will be apparent that if it is desired to mount the roll beneath the applicator the bracket, etc could be on the bottom frame 26 and the shape deforming device 64 described below reoriented as required. The axial position of the roll may be adjusted by an adjustable mounting as schematically represented by the double ended arrow 55 and as will be describe in more detail with reference to FIGS. 5 and 6 so that the position of the tape axially along the applicator roll 38 may be correspondingly adjusted.

The axis of rotation of the hub 54 and thus the tape roll 56 is perpendicular to that of the applicator and wipe down rolls 38 and 40 i.e. is horizontal so that the plane of the tape 56 leaving the tape roll 56 must be turned 90° on the tape path 58 before it reaches the applicator roll 38. In order to accomplish this the tape 59 leaving the roll 56 on tape path 58 is guided via guide roller 60 (mounted on the arm 52) directs the tape 59 to the inlet end 80 of the deforming member or device 64 the inlet end 80 of which is mounted to the post 62.

It will be apparent that the axis of rotation of the guide roll 60 is horizontal to correspond with the plane of the tape 59 leaving the tape roll 56 i.e. parallel to the axis of rotation of the hub 54. The tape 59 passes from roll 60 onto the deformation device or member 64.

This device 64 as above described has its inlet end 80 mounted to the post 62 which in turn is mounted on and projects from the bracket 50. The outlet end 82 of the device or member 64 is mounted on a post 66 which in turn is mounted on the applicator 24 between the frames 26 and 28 and extends perpendicular thereto. A deforming edge 68 over which the tape 59 passes to reorient the plane of the tape 59 as required is positioned between the inlet and outlet ends 80 and 82. It will be apparent that the inlet end 80 and outlet end 82 are in mutually perpendicular planes i.e. the plane of the device 64 at the inlet end 80 is horizontal and at the outlet end 82 is vertical.

Turning now to FIGS. 7 which illustrates in more detail the preferred form of the tape deforming device or member 64.

Figures 7A, 7B, 7C:
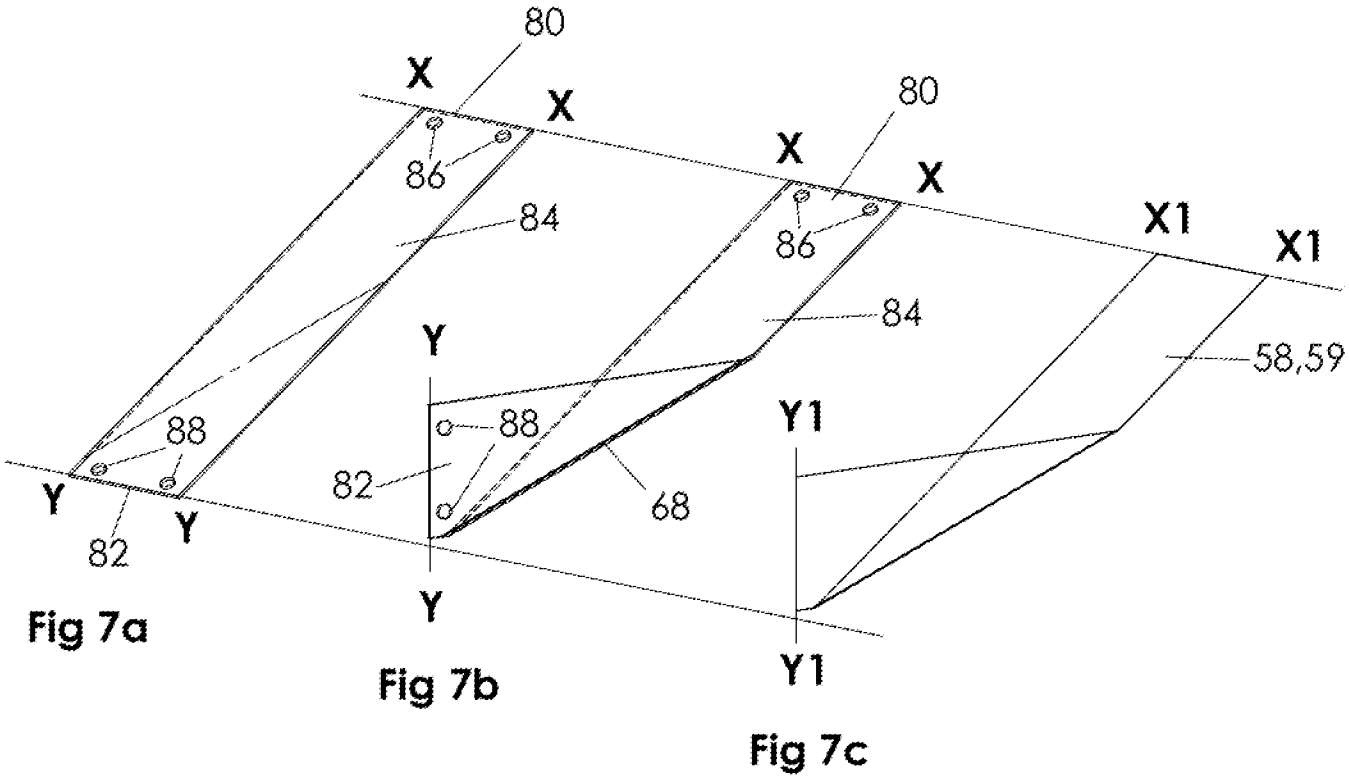
FIG. 7*a* is an isometric illustration showing the deforming member before it is formed into its operative shape.
FIG. 7*b* is an isometric view of FIG. 7*a* after the deforming member has been formed into its operative shape.
FIG. 7*c* is an isometric view of a strip tape illustrating how it is deformed to reorient the plane of the tape as the tape passes over the deformed member tape as s shown in FIG. 7*b*.

The deforming device or member 64 is formed from a rectangular strip 84 of thin gauge smooth surface preferably of metal or more preferably of stainless steel. The ends at the longitudinal ends of the strip 84 form the inlet 80 and outlet 82 ends of the device 64 positioned in their respective planes X-X and Y-Y (see FIGS. 7). The strip 84 is shown in its flat state in FIG. 7*a* and is bent diagonally as illustrated in FIG. 7*b* to define the deforming edge 68 and thus the desired shape of tape path 58 from the entry end 80 to the exit end 82 of the member or device 64. The deforming edge 68 is a compound angle, the intercepting true angle is not at 90 degrees, but it is important as long as both the inlet end and outlet ends 80 and 82 are perpendicular to their mounting surfaces, it is more accurate.

It will be apparent that in the bent shape illustrated in FIG. 7*b* the planes X-X and Y-Y at the inlet and outlet ends 80 and 82 are mutually perpendicular i.e. oriented at 90° to each other. The inlet end 80 is fixed to the post 62 preferably by screws (not shown) passing through the holes 86 and the outlet end 82 to the post 66 via screws (not shown) that pass through the holes 88. The folded plate 84 anchored on both ends 80 and 82 at 90° is more precise and definite in keeping the required geometry as both ends are used as a datum.

Since tape misalignment is caused by uneven tension and displacement of tape, the deforming device or member 64 ensures the tape 59 is in essentially total contact with the surface of the member 64 and is in the plane X1-X1 at the inlet end 80, is turned through 90° as it passes over the edge 68 and leaves in plane Y1-Y1 at the outlet end 82 (see FIG. 7*c*). The tape is held to the surface of the device 64 with even distribution of force by tension in the tape 59.

The deforming edge 68 is formed with a suitable bending radius to avoid stress concentration as the tape 59 change it direction of travel as it passes there around.

The tape 59 travels along path 58 from the roll 60 onto the inlet end 80 of the deforming device 64 around the deforming edge 68 where the plane of the tape is changed from plane X1-X1 to plane Y1-Y1 i.e. changed from horizontal leaving the guide roll 60 and fed to the inlet end 80 to substantially vertical as it passes around the edge 68 and leave the outlet end 82 in a substantially vertical plane and onto the intake guide roll 70 that rotates on a substantially vertical axis and then passed over or around the other conventional parallel guiding or feed control rolls of the applicator 24 that define the path 58 of the tape from the intake roll 70 to the applicator roll 38.

A simple substantially planar plate (not shown) anchored at one point only (outlet end) and provided with an angle edge to replace edge 68 above described requires some setting and positioning to align the tape, and while such a device may be made to operate it will not perform nearly as well as the device described above.

Figure 4:
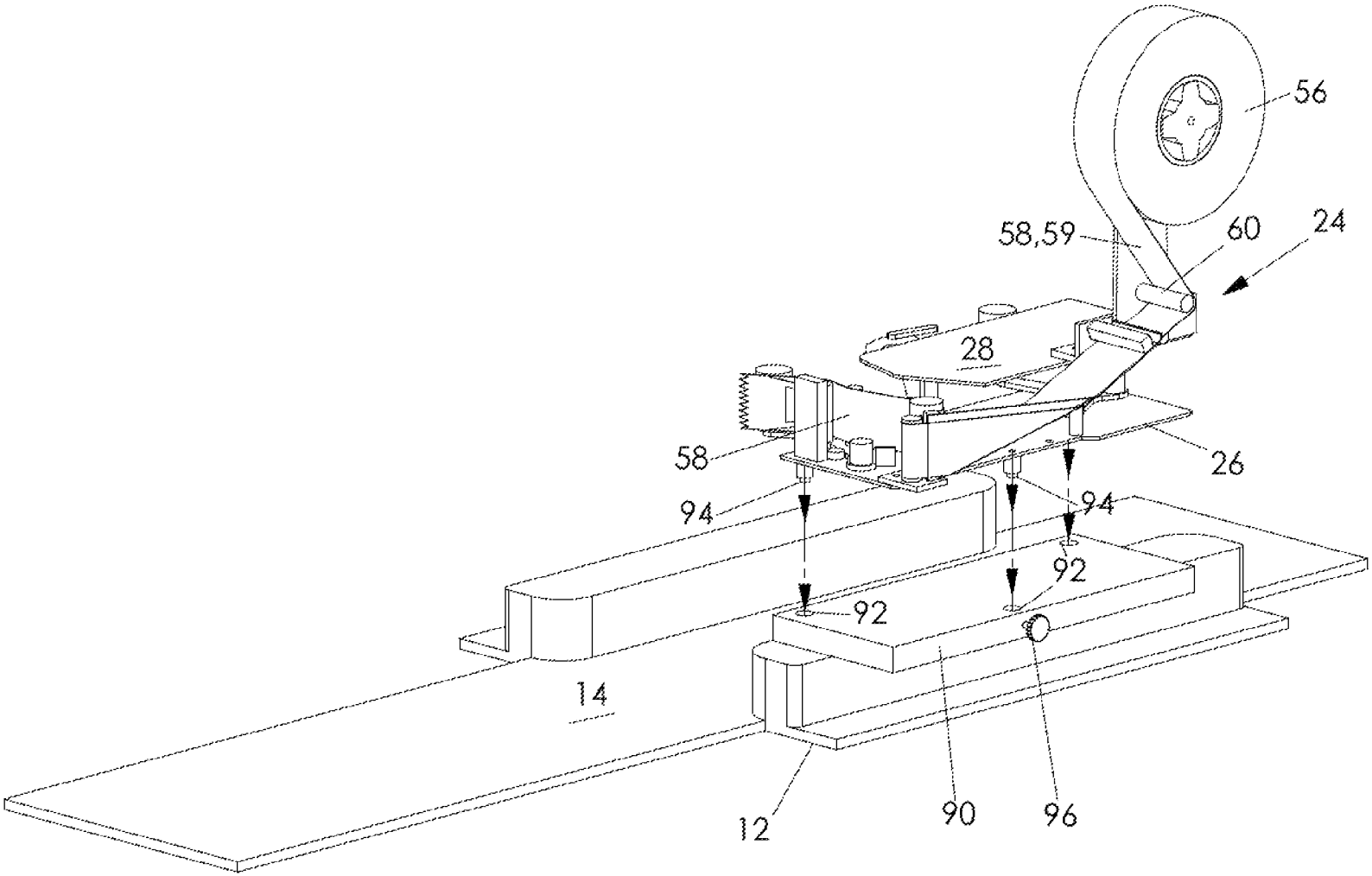
FIG. 4 is an isometric illustration of the present invention illustrating the releasable mounting of the tape applicator on the machine mounting bracket on the taping machine frame.

Turning to FIG. 4 the preferred form of removable amounting for the tape head 24 is illustrated. As shown a suitable platform 90 is provided on the machine frame 12 and has suitable sockets or holes 92 (3 used in the illustrated arrangement) provided there in. Mating pegs or the like 94 project from the bottom fame member 26 of the applicator 24 and are positioned to be received in their respective hole 92 as indicated by the arrow extending there between. A suitable set screw or the like 96 is threaded through the plate 90 and intersects with one of the holes 92 so that when the pins 94 are seated in the holes 92 the set screw 96 may be screwed so that the end thereof applies pressure against the peg 94 to hold the applicator 24 in mounted position on the frame 12. Only one such set screw 96 is required and normally will be positioned as shown in FIG. 4. It will be apparent that the tape applicator 24 may be applied to or removed from the machine frame 12 by appropriately manipulating the set screw 96 and simply moving the application vertically into or out of the machine.

Figure 5B:
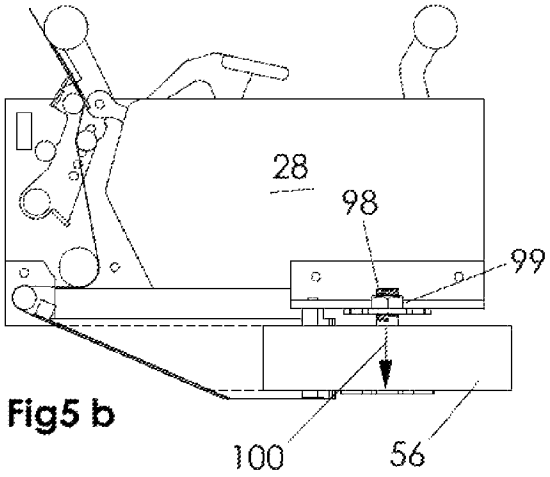
FIG. 5*b* is a plan view of FIG. 5*a* showing the corresponding adjusted position of tape roll for application as illustrated in FIG. 5*a* i.e. the tape roll at its outermost position.
Figure 5A:
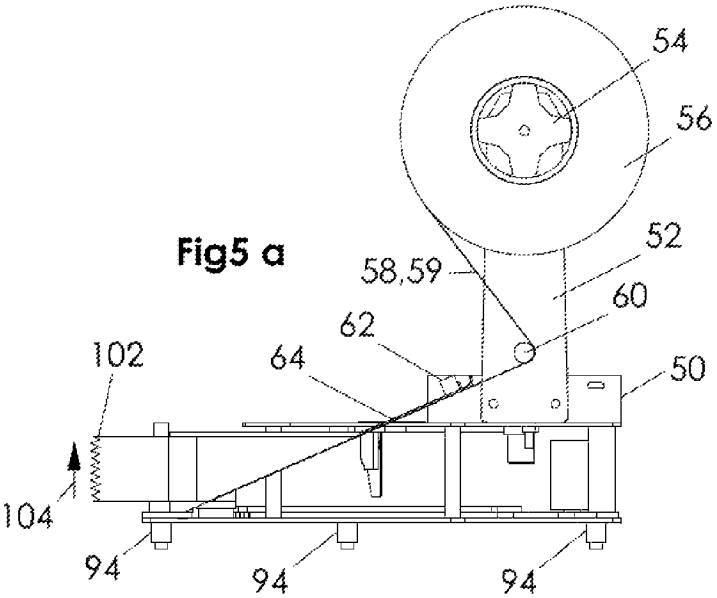
FIG. 5*a* is a side view of the present invention showing the tape positioned for application to a case or carton at the upper application position

As indicated by the arrow 55 the axial position of the roll 56 may be adjusted to raise or lower the position of the tape 59 at the point of application of the tape 59 to the container 18 as clearly illustrated in FIGS. 5 and 6. As shown in FIGS. 5*a* and 5*b* the roll 56 has been moved to its position remote from the arm 52 as indicated by the arrow 100 (see FIG. 5*b*).

Figure 6B:
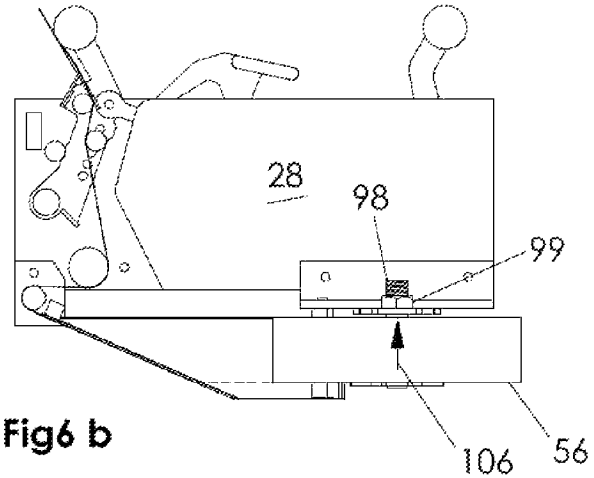
FIG. 6*b* is a plan view of FIG. 6*a* showing the corresponding adjusted position of tape roll for application as illustrated in FIG. 6*a* i.e. the tape roll at its innermost position.
Figure 6A:
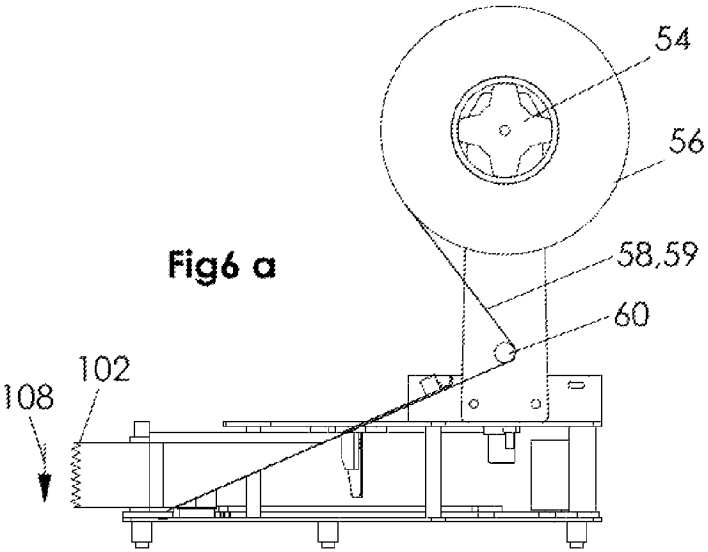
FIG. 6*a* is a side view of the present invention similar to FIG. 5*a* but showing the tape positioned for application to a case or carton at the lower application position.

So positioning the roll 56 results in the free end 102 of the tape 59 being positioned in its uppermost position as indicated by the arrow 104. In FIGS. 6*a* and 6*b* the roll 56 is illustrated in its innermost position as indicated by the arrow 106 which positions the free end 102 of the tape into its lowermost position as indicated by the arrow 108. The position of the roll 56 and thus of the free end 102 may be set as desired anywhere between the two extremes.

The ability to precisely align the tape 59 from the source of tape 56 to the application point by the present invention, the taping position i.e. the free end 102 at the application point can be adjusted up and down vertically to for example correspond with the center line of the carton 18 (normally the meeting of flaps 20 and 22 of the carton 18), to ensure that both flaps 20 and 22 are taped evenly. The tape position adjustment at the application point 102 is achieved by adjusting the hub 54 outward horizontally (see FIG. 5*b*) to move the tape position 102 upwardly (see FIG. 5*a*). Adjusting the hub (54) inward horizontally (see FIG. 6*b*) moves the tape position 102 downward. The position of the tape roll 56 axially may be set at any selected position between the extreme adjustment positions illustrated.

Any suitable means for axially adjusting the position of the roll 56 between the positions illustrated in FIGS. 5 and 6 may be employed In the one currently employed the hub 54 rotates on a shaft 98 one end of which is threaded into a threaded hole of arm 52, and locked in adjusted position by a lock nut 99 and locked in position. To adjust: loosen the lock nut 99, turn the threaded shaft 98 in or out to a selected tape roll position and then tighten the lock nut to keep the adjustment in place.

It will be apparent that the axial lengths of all the guide rolls and of the edge 68 must be sufficient to accommodate the adjustment of the position of the roll 56. It will also be apparent that the tape has an adhesive side and a non-adhesive side and the latter contacts the guides and deforming device 64 as the tape 59 travels along the tape path 58

Having described the invention, modifications will be evident to those skilled in the art without departing from the scope of the invention as defined in the appended claims.

The invention claimed is:

1. A tape applicator to apply tape onto a vertical face of a case comprising a machine frame, a tape applicator removably mounted on said machine frame, said tape applicator having a tape applying roll for applying tape against a vertical face of a case moved thereby, said tape applicator having substantially parallel top and bottom fame members, an arm mounted on one of said top and bottom frame members and extending perpendicular thereto and a tape roll mounting for mounting a tape roll on said tape applicator, said tape roll mounting including an axially adjustable hub mounted on said arm for rotation on an axis substantially perpendicular to said arm, said tape roll providing a source of tape to be applied, said tape roll mounting mounts said tape roll for rotation on a horizontal axis, said tape extending in a plane, when said tape leaves said tape roll said-plane is horizontal and a tape deforming device that includes a rectangular strip having a horizontal inlet end fixed to said applicator and a vertical outlet end spaced from said inlet end and fixed to said applicator, said strip being bent to form a deforming edge between said inlet and outlet ends over which said tape travels to turn said tape so that said plane in which said tape extends is turned 90° from horizontal to vertical so that when leaving said deforming device said plane is parallel to said vertical face of said case and guides for directing said tape along a tape path to said tape deforming device and to said applicator roll.

* * * * *